US010762783B2

(12) United States Patent
Park

(10) Patent No.: US 10,762,783 B2
(45) Date of Patent: Sep. 1, 2020

(54) VEHICLE SAFETY DRIVING GUIDANCE SYSTEM AND METHOD

(71) Applicants: HYUNDAI MOTOR COMPANY, Seoul (KR); KIA MOTORS CORPORATION, Seoul (KR)

(72) Inventor: Sung Hwan Park, Seongnam-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/433,749

(22) Filed: Jun. 6, 2019

(65) Prior Publication Data

US 2020/0193828 A1 Jun. 18, 2020

(30) Foreign Application Priority Data

Dec. 12, 2018 (KR) ..... 10-2018-0159728

(51) Int. Cl.

| | |
|---|---|
| ***G08B 1/00*** | (2006.01) |
| ***G08G 1/16*** | (2006.01) |
| ***G08G 1/052*** | (2006.01) |
| ***G08G 1/0967*** | (2006.01) |

(52) U.S. Cl.

CPC ..... *G08G 1/16* (2013.01); *G08G 1/052* (2013.01); *G08G 1/0967* (2013.01)

(58) Field of Classification Search

CPC ..... G08G 1/16
USPC ..... 340/901–905, 988, 995.13, 435
See application file for complete search history.

(56) References Cited

U.S. PATENT DOCUMENTS

| | | | | |
|---|---|---|---|---|
| 10,032,379 | B1 * | 7/2018 | Chambers | G08G 1/166 |
| 2010/0045488 | A1 * | 2/2010 | Bell | G08G 1/161 340/988 |
| 2013/0030688 | A1 * | 1/2013 | Shimizu | G08G 1/161 701/301 |
| 2015/0310742 | A1 * | 10/2015 | Albornoz | G08G 1/096716 340/905 |
| 2016/0150070 | A1 * | 5/2016 | Goren | G08G 1/096775 455/404.2 |
| 2018/0079359 | A1 * | 3/2018 | Park | B60W 50/14 |

* cited by examiner

*Primary Examiner* — Tai T Nguyen
(74) *Attorney, Agent, or Firm* — Morgan, Lewis & Bockius LLP

(57) ABSTRACT

A vehicle safety driving guidance system includes a communication device that performs communication with a vehicle terminal, a data collection device that collects traffic information of a road section on which a vehicle having the vehicle terminal mounted therein travels, and a processor that provides safety driving guide information of the road section based on the traffic information collected by the data collection device.

24 Claims, 12 Drawing Sheets

| CLASSIFICATION | SAFETY SPEED | RISK OF HIGH SPEED | RISK OF LOW SPEED |
|---|---|---|---|
| AVERAGE | 58.7km/h | 74.4km/h | 44.4km/h |
| ERROR | 12.3km/h | 15.7km/h | 14.4km/h |

VEHICLE SAFETY DRIVING GUIDANCE SYSTEM AND METHOD

CROSS-REFERENCE TO RELATED APPLICATION

This application claims the benefit of priority to Korean Patent Application No. 10-2018-0159728, filed on Dec. 12, 2018 in the Korean Intellectual Property Office, the entire contents of which are incorporated herein by reference.

TECHNICAL FIELD

The present disclosure relates to a vehicle safety driving guidance system and method.

BACKGROUND

With the development of information technology (IT), the information technology is integrated into a means of transportation and a traffic facility to support a service that collects and provides traffic information to a driver in real time. The traffic information service system may improve existing traffic-related problems such as traffic congestion, traffic accidents, logistics costs, and the like. Accordingly, studies on technologies for providing safety status information that allows a driver to safely drive (operate) a vehicle according to ever-changing road conditions have been increasingly conducted.

SUMMARY

The present disclosure has been made to solve the above-mentioned problems occurring in the prior art while advantages achieved by the prior art are maintained intact.

An aspect of the present disclosure provides a vehicle safety driving guidance system and method for guiding a safety travel speed by using real-time traffic information.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a vehicle safety driving guidance system may include a communication device that performs communication with a vehicle terminal, a data collection device that collects traffic information of a road section on which a vehicle having the vehicle terminal mounted therein travels, and a processor that provides safety driving guide information of the road section based on the traffic information collected by the data collection device.

The traffic information may include at least one of travel speeds of probe vehicles travelling on the road section, speed limits, a presence or absence of a traffic light, signal state information of the traffic light, or a congestion point.

The processor may calculate an average travel speed by collecting travel speeds of probe vehicles and may determine a speed range of the vehicle based upon setting the calculated average travel speed as a safety travel speed.

The processor may calculate a mean error by calculating an error between the safety travel speed and a travel speed of each of the probe vehicles and may set a safety range using the calculated mean error and the safety travel speed.

The processor may set a hazard range using a middle value between the safety travel speed and a highest speed among the travel speeds of the probe vehicles and an error between the middle value and the highest speed.

The processor may set a hazard range using a middle value between the safety travel speed and a lowest speed among the travel speeds of the probe vehicles and an error between the middle value and the lowest speed.

The processor may set a range above the highest speed of the hazard range or a range below the lowest speed of the hazard range as a range with a risk of collision.

The processor may extract at least one of a congestion point and a position of a traffic light in the road section as a speed change point, may determine a target speed at the speed change point, and may provide the determined target speed as the safety driving guide information.

The processor may additionally provide information regarding a current signal state of the traffic light and a signal change frequency of the traffic light when extracting the position of the traffic light as the speed change point.

The processor may determine a safety range, a hazard range, and a collision risk range with respect to speed limits of the road section and may provide the safety range, the hazard range, and the collision risk range as the safety driving guide information.

The vehicle terminal may display a speedometer by dividing a range between a lowest speed and a highest speed of the speedometer into a safety range, a hazard range, and a collision risk range, based on the safety driving guide information.

The vehicle terminal may display a target speed included in the safety driving guide information and a current vehicle speed.

The vehicle terminal may additionally display a remaining distance from a position of the vehicle to a speed change point included in the safety driving guide information.

The vehicle terminal may additionally display a current signal state and a remaining amount of time until the current signal state is changed, based on the safety driving guide information that includes the current signal state and a signal change frequency of the traffic light.

According to another aspect of the present disclosure, a vehicle safety driving guidance method includes receiving a request for traffic information from a vehicle terminal, collecting traffic information of a road section on which a vehicle having the vehicle terminal mounted therein travels, in response to the request from the vehicle terminal, and providing safety driving guide information of the road section, based on the collected traffic information.

The collecting of the traffic information may include collecting at least one of travel speeds of probe vehicles travelling on the road section, speed limits, a presence or absence of a traffic light, signal state information of the traffic light, or a congestion point.

The providing of the safety driving guide information may include setting a safety travel speed, based on travel speeds of probe vehicles travelling on the road section and setting a speed range with respect to the safety travel speed.

The setting of the speed range may include calculating a mean error by calculating an error between the safety travel speed and a travel speed of each of the probe vehicles and setting a safety range using the calculated mean error and the safety travel speed.

The setting of the speed range may include setting a hazard range using a middle value between the safety travel speed and a highest speed among the travel speeds of the probe vehicles and an error between the middle value and the highest speed.

The setting of the speed range may include setting a hazard range using a middle value between the safety travel speed and a lowest speed among the travel speeds of the probe vehicles and an error between the middle value and the lowest speed.

The providing of the safety driving guide information may include extracting at least one of a congestion point and a position of a traffic light in the road section as a speed change point, determining a target speed at the speed change point, and providing the determined target speed as the safety driving guide information.

The providing of the safety driving guide information may further include additionally providing information regarding a current signal state of the traffic light and a signal change frequency of the traffic light when extracting the position of the traffic light as the speed change point.

The providing of the safety driving guide information may include determining a safety range, a hazard range, and a collision risk range with respect to speed limits of the road section and providing the safety range, the hazard range, and the collision risk range as the safety driving guide information.

After the providing of the safety driving guide information, the vehicle terminal may display a speedometer by dividing a range between a lowest speed and a highest speed of the speedometer into a safety range, a hazard range, and a collision risk range, based on the safety driving guide information.

After the providing of the safety driving guide information, the vehicle terminal may display a current vehicle speed and a target speed included in the safety driving guide information.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
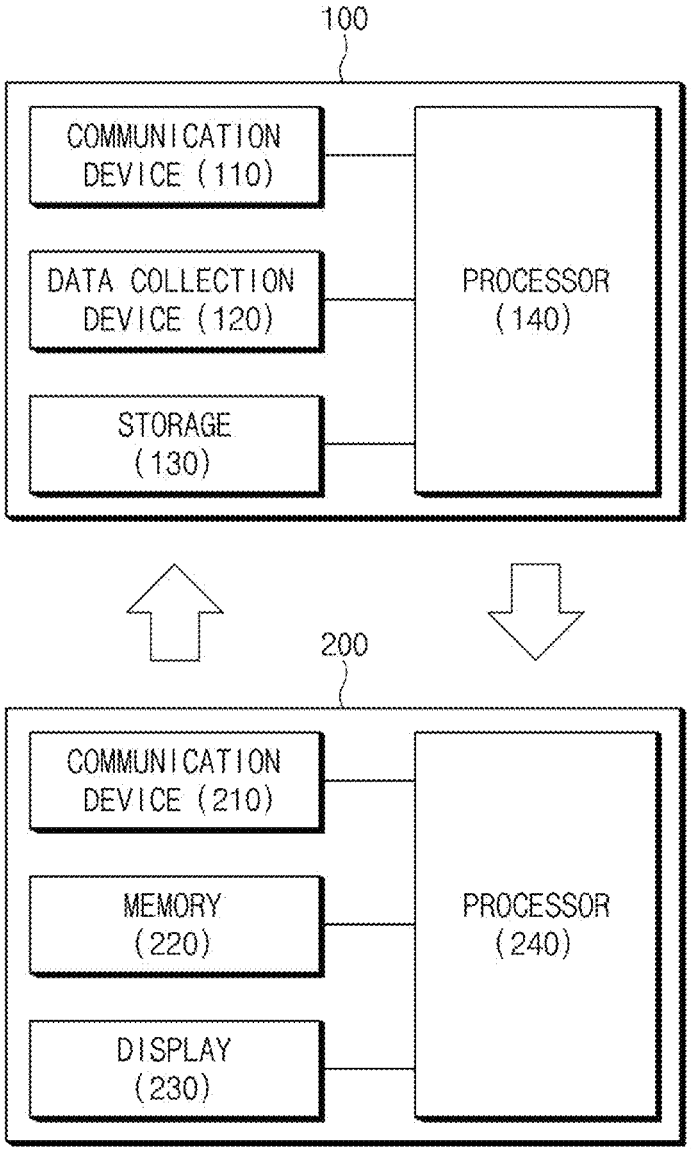
FIG. 1 is a view illustrating a configuration of a vehicle safety driving guidance system according to an embodiment of the present disclosure.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

In describing the components of the embodiment according to the present disclosure, terms such as first, second, "A", "B", (a), (b), and the like may be used. These terms are merely intended to distinguish one component from another component, and the terms do not limit the nature, sequence or order of the constituent components. Unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

Figure 2:
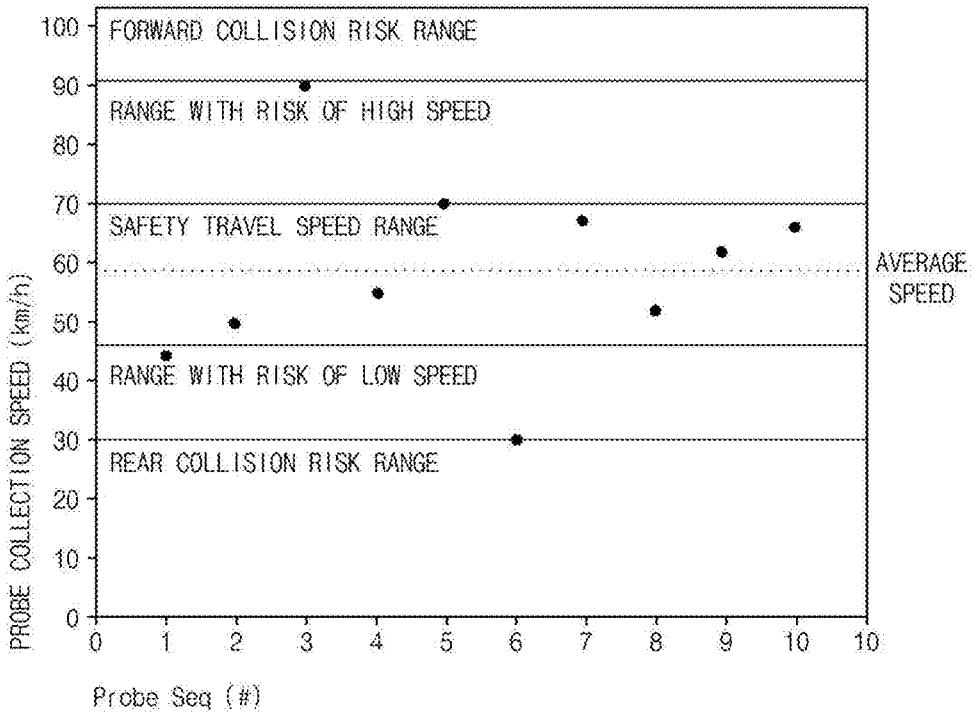
FIG. 2 is a view illustrating a method of generating safety driving guide information according to an embodiment of the present disclosure.

FIG. 1 is a view illustrating a configuration of a vehicle safety driving guidance system according to an embodiment of the present disclosure, and FIG. 2 is a view illustrating a method of generating safety driving guide information according to an embodiment of the present disclosure.

Referring to FIG. 1, the vehicle safety driving guidance system includes a traffic information service device 100 and a vehicle terminal 200 that are connected with each other via a network.

The traffic information service device 100 provides safety driving guide information based on traffic information of a road section on which a vehicle is travelling. The traffic information service device 100 includes a communication device 110, a data collection device 120, storage 130, and a processor 140.

The communication device 110 may connect to the network to exchange data with the vehicle terminal 200. The communication device 110 may be a hardware device implemented with various electronic circuits to transmit and receive signals via wireless or landline connections. The communication device 110 may connect to at least one network among a wireless internet network such as telematics, wireless LAN (WLAN) (e.g., WiFi), wireless broadband (Wibro), and/or world interoperability for microwave access (Wimax), a wired internet network such as local area network (LAN), wide area network (WAN), Ethernet, and/or integrated services digital network (ISDN), and a mobile communication network such as code division multiple access (CDMA), global system for mobile communication (GSM), long term evolution (LTE), and/or LTE-Advanced.

The data collection device 120 may collect traffic information (road condition information) for each road section in real time through probe vehicles, road side equipment (RSE), a traffic light controller, and a loop detector. The traffic information may include travel speeds (probe data) measured by the probe vehicles in real time, the speed limits specified to the road section, the speed limits (the regulation speeds) according to the road grade of the road section, the position and the signal state of a traffic light, and a congestion point.

The storage 130 may store the information collected through the data collection device 120 and may store a speed determination algorithm. The storage 130 may also store map information and road information.

The storage 130 may store software programmed to cause the processor 140 to perform predetermined operations and may temporarily store input/output data. The storage 130 may be implemented with at least one storage medium (recording medium) among storage media such a flash memory, a hard disk, a secure digital (SD) card, an random access memory (RAM), a static random access memory (SRAM), a read only memory (ROM), a programmable read only memory (PROM), an electrically erasable and programmable ROM (EEPROM), an erasable and programmable ROM (EPROM), a register, a removable disk, and web storage.

The processor 140 controls an overall operation of the traffic information service device 100. The processor 140 may be implemented with at least one of an application specific integrated circuit (ASIC), a digital signal processor (DSP), programmable logic devices (PLDs), field programmable gate arrays (FPGAs), a central processing unit (CPU), microcontrollers, and microprocessors.

The processor 140 may take the form of one or more processor(s) and associated memory storing program instructions, and in some examples the one or more processor(s) may be used to implement the functions of both the data collection device 120 and the processor 140.

When receiving a request for traffic information from the vehicle terminal 200, the processor 140 collects traffic information of a road section on which a vehicle having the vehicle terminal 200 mounted therein travels, through the data collection device 120. The processor 140 may analyze the collected traffic information and may provide safety driving guide information.

More specifically, the processor 140 may collect travel speeds (probe data) measured by probe vehicles that travel on the road section on which the vehicle having the vehicle terminal 200 mounted therein, which requests the traffic information, travels. If there is no probe vehicle travelling on a specific road section at the time of collecting probe vehicle data, the processor 140 cannot collect probe data on the corresponding specific road section.

The processor 140 calculates the average value (the safety travel speed) of travel speeds measured by probe vehicle(s) travelling on the same road section. That is, the processor 140 calculates the real-time average travel speed for the road section. The processor 140 calculates the deviation (or, the error or the difference) between the travel speed of each probe vehicle and the average travel speed and calculates the average of the calculated deviations, that is, the mean deviation.

The processor 140 determines a safety travel speed range (a safety range) using the average travel speed and the mean deviation. For example, as illustrated in FIG. 2, the processor 140 determines the speed range of 46.4 km/h to 71 km/h to be the safety travel speed range (the safety range) when the average travel speed is 58.7 km/h and the mean deviation (the mean error) is 12.3 km/h.

Furthermore, the processor 140 calculates the middle value (the average value) between the average travel speed and the highest of the collected travel speeds of the probe vehicles. For example, as illustrated in FIG. 2, the processor 140 determines the middle value of 74.4 km/h between the average travel speed of 58.7 km/h and the highest travel speed of 90 km/h to be a reference value of a range (a hazard range) with a risk of high speed when the travel speed of probe vehicle #3 is the highest speed of 90 km/h. The processor 140 calculates the error between the highest travel speed of 90 km/h and the middle value of 74.4 km/h and determines the range (the hazard range) with the risk of high speed, based on the middle value between the average travel speed and the highest travel speed and the error between the highest travel speed and the middle value. That is, the processor 140 determines the speed range of 71 km/h to 90.1 km/h to be the range with the risk of high speed.

The processor 140 calculates the middle value (the average value) between the average travel speed and the lowest of the collected travel speeds of the probe vehicles. The processor 140 calculates the error between the calculated middle value and the lowest travel speed. The processor 140 determines a range (a hazard range) with a risk of low speed using the calculated middle value and the error.

For example, as illustrated in FIG. 2, the processor 140 calculates the middle value (the average value) of 44.4 km/h between the lowest travel speed of 30 km/h and the average travel speed of 58.7 km/h when the travel speed of probe vehicle #6 is the lowest speed of 30 km/h. The processor 140 may calculate the difference of 14.4 km/h between the middle value of 44.4 km/h and the lowest travel speed of 30 km/h and may determine the range with the risk of low speed, based on the calculated difference of 14.4 km/h and the middle value of 44.4 km/h.

The processor 140 may determine a range above the highest speed in the range with the risk of high speed to be a forward collision risk range (a collision risk range) and may determine a range below the lowest speed in the range with the risk of low speed to be a rear collision risk range (a collision risk range).

As described above, the processor 140 may divide the range between the highest vehicle speed and the lowest vehicle speed into the plurality of speed ranges, that is, the safety range, the hazard ranges (the range with the risk of high speed and the range with the risk of low speed), and the collision risk ranges (the forward collision risk range and the rear collision risk range), with respect to the safety travel speed (the safety speed). The processor 140 may determine the boundary speeds (the lowest and highest speeds) of each speed range and may provide the determined boundary speeds of the speed range as safety driving guide information.

When a traffic light is present in the road section, the processor 140 may generate safety driving guide information in view of the position, the signal state, and the signal change frequency of the traffic light. When the traffic light is present in the road section and the signal state at the time that the vehicle (the request vehicle) requesting the traffic information reaches a stop line matching the traffic light is a stop signal, the processor 140 determines a forward speed change point to be the stop line matching the position of the traffic light and determines a target speed to be 0 km/h. The processor 140 may calculate the deceleration and the deceleration distance required for the request vehicle to reach the forward speed change point at the target speed.

When a congestion point is present in the road section, the processor 140 extracts a point (e.g., a congestion point) where the travel speed is changed by a set speed (e.g., 30 km/h) or more, and determines the extracted point to be a forward speed change point (a speed change point). Furthermore, the processor 140 determines the travel speed in the congestion section, that is, the changed travel speed to be a target speed. The processor 140 may calculate the deceleration and the deceleration distance required for the travel speed of the vehicle to reach the target speed when the vehicle arrives at the speed change point.

The processor 140 may determine a safety range based on the deceleration and the deceleration distance.

The processor 140 may determine a safety range (a safety driving range), a range with a risk of high speed, and a range with a risk of low speed, with respect to the speed limits (the lower speed limit and the upper speed limit) of the road section. In this case, the speed limits may be speed limits specified to the road section or speed limits according to the road grade of the road section.

The vehicle terminal 200 is an electronic device capable of wireless communication. The vehicle terminal 200 may be implemented with a telematics terminal or a navigation terminal. The vehicle terminal 200 includes a communication device 210, a memory 220, a display 230, and a processor 240.

The communication device 210 supports communication with the traffic information service device 100. The communication device 210 may be a hardware device implemented with various electronic circuits to transmit and receive signals via wireless or landline connections. The communication device 210 transmits or receives data using wireless internet, telematics, mobile communication, and/or vehicle to everything (V2X). Vehicle to vehicle (V2V), vehicle to infrastructure (V2I), vehicle-to-nomadic devices (V2N), and/or in-vehicle network (IVN) may be used as the V2X technology. Here, the IVN is implemented with a controller area network (CAN), a media oriented systems transport (MOST) network, a local interconnect network (LIN), and/or x-by-wire (Flexray).

The memory 220 may store programs for operations of the processor 240 and may also temporarily store input/output data. The memory 220 may be implemented with at least one storage medium among storage media such as a flash memory, a hard disk, an SD card, a RAM, an SRAM, a ROM, a PROM, an EEPROM, an EPROM, a register, a removable disk, and web storage.

The display 230 may output progress states and outcomes according to operations of the processor 240 with visual information. The display 230 may include one or more of a liquid crystal display (LCD), a thin film transistor-liquid crystal display (TFT LCD), an organic light-emitting diode (OLED) display, a flexible display, a three-dimensional (3D) display, a transparent display, a head-up display (HUD), a touch screen, and a cluster.

The display 230 may include a sound output module, such as a speaker, which is capable of outputting audio data. For example, the display 230 may display safety driving guide information and may output a sound signal (an audio signal) through the speaker.

Furthermore, the display 230 may be implemented with a touch screen combined with a touch sensor and may be used as an input device as well as an output device. A touch film or a touch pad may be used as the touch sensor.

The processor 240 may make a request for traffic information of the road section on which the vehicle is travelling, to the traffic information service device 100. The processor 240 transmits a request message for the traffic information to the traffic information service device 100 via the communication device 210. The processor 240 may transmit information regarding the current position of the vehicle together when transmitting the request message for the traffic information. Here, the current position of the vehicle may be measured by a positioning device such as a global positioning system (GPS) receiver.

The processor 240 may receive traffic information (safety driving guide information) from the traffic information service device 100 via the communication device 210. The processor 240 may differently display a safety range, hazard ranges, and collision risk ranges on the speedometer of the vehicle, based on the safety driving guide information. For example, the processor 240 may display the safety range in green, the hazard ranges in yellow, and the collision risk ranges in red.

The processor 240 measures the current travel speed of the vehicle through a speed sensor mounted in the vehicle and determines which of the classified speed ranges the measured vehicle speed belongs to. The processor 240 may display the speed range to which the current travel speed (the current vehicle speed) of the vehicle belongs, in the form that a user can recognize.

The processor 240 may display the speedometer included in the cluster by dividing the range between the lowest speed and the highest speed of the speedometer into a safety range, hazard ranges, and collision risk ranges, based on the safety driving guide information included in the traffic information. The processor 240 may adjust the position of the needle on the speedometer, which points to graduations, according to the current vehicle speed. Accordingly, the user (the driver) may identify the position of the needle and may simultaneously determine whether the current vehicle speed is within the safety range.

Figure 3:
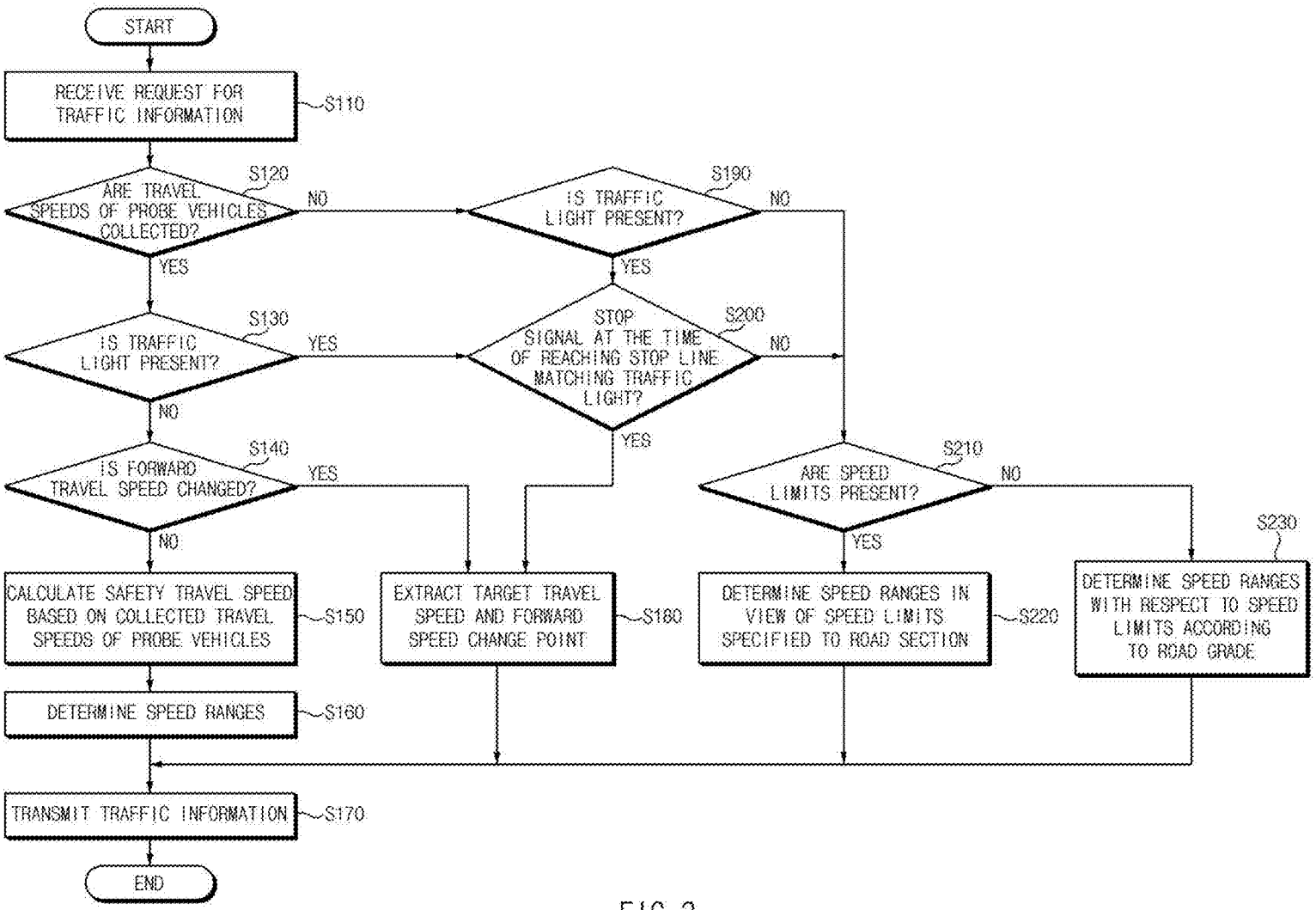
FIG. 3 is a flowchart illustrating a vehicle safety driving guidance method according to an embodiment of the present disclosure.

FIG. 3 is a flowchart illustrating a vehicle safety driving guidance method according to an embodiment of the present disclosure.

The processor 140 of the traffic information service device 100 receives a request for traffic information from the vehicle terminal 200 via the communication device 110 (S110). The vehicle terminal 200 may transmit information regarding the position of the vehicle together when requesting the traffic information. The processor 140 may identify the road section on which the vehicle is travelling, based on the information regarding the position of the vehicle.

The processor 140, when receiving the request for the traffic information, determines whether travel speeds of probe vehicles are collected (S120). The processor 140 collects travel speeds of probe vehicle(s) that travel on the road section on which the vehicle (the request vehicle) that requests the traffic information is travelling. If there is no probe vehicle travelling on the same road section as that on which the request vehicle is travelling, the processor 140 cannot collect travel speeds of probe vehicles.

After collecting the travel speeds of the probe vehicles, the processor 140 determines whether a traffic light is present in the road section on which the request vehicle is travelling (S130). The processor 140 may determine whether a traffic light is present in the road section on which the request vehicle is travelling, with reference to map information and road information. At this time, the processor 140 may identify the position where the traffic light is installed and the position of a stop line matching the corresponding traffic light.

When it is determined that there is no traffic light in the road section, the processor 140 determines whether there is a variation in forward travel speed (S140). The processor 140 determines whether there is a point (e.g., a congestion point) where the travel speeds of vehicles ahead (in the progress direction) vary, based on the position of the request vehicle. In this case, the processor 140 may determine whether there is a point where the average travel speed of the vehicles ahead is changed by a set speed (e.g., 30 km/h) or more.

When it is determined that there is no variation in forward travel speed, the processor 140 analyzes the distribution of the collected travel speeds of the probe vehicles and calculates a safety travel speed (S150). The processor 140 calculates the safety travel speed of the corresponding road section by analyzing the distribution of the travel speeds of the probe vehicles. That is, the processor 140 determines the average travel speed of the probe vehicles to be the safety travel speed.

The processor 140 determines a speed range according to the risk level of the road section (S160). The processor 140 may divide the speed range into a safety range, hazard ranges (a range with a risk of high speed and a range with a risk of low speed), and collision risk ranges (a forward collision risk range and a rear collision risk range), with respect to the safety travel speed.

The processor 140 transmits the speed range information to the vehicle terminal 200 as traffic information (S170). The speed range information included in the traffic information may be used as safety driving guide information.

When it is determined in step S140 that there is a variation in forward travel speed, the processor 140 extracts a target travel speed and a speed change point (S180). Here, the target travel speed is a changed travel speed, and the speed change point refers to a point where the travel speed is changed by a set speed or more. Thereafter, the processor 140 may calculate a safety range based on the extracted target travel speed and the extracted speed change point and may provide the safety range as safety driving guide information (S170).

When the travel speeds of probe vehicles are not collected in step S120, the processor 140 determines whether a traffic light is present in the road section (S190). That is, the processor 140 may determine whether a traffic light is present ahead of the request vehicle.

When it is determined that a traffic light is present in the road section, the processor 140 determines whether the signal state at the time that the request vehicle reaches a stop line matching the position of the traffic light is a stop signal (S200). When it is determined that the signal state is the stop signal, the processor 140 extracts a target travel speed and a speed change point (S180). At this time, the processor 140 determines the target travel speed to be 0 km/h and the speed change point to be the position of the stop line matching the traffic light. Thereafter, the processor 140 calculates a safety range based on the extracted target travel speed and the extracted speed change point and provides the safety range as safety driving guide information (S170).

When it is determined in step S190 that there is no traffic light in the road section, or when it is determined in step S200 that the signal state at the time that the request vehicle reaches the stop line matching the traffic light is not a stop signal, the processor 140 determines whether there are speed limits specified to the road section (S210). In this case, the processor 140 may determine whether there are speed limits specified to the road section, with reference to the map information and the road information.

When it is determined that there are speed limits specified to the road section, the processor 140 may determine a safety range, hazard ranges, and collision risk ranges with respect to the corresponding speed limits (S220). Meanwhile, when it is determined that there are no speed limits specified to the road section, the processor 140 may determine a safety range, hazard ranges, and collision risk ranges with respect to the speed limits according to the road grade of the road section (S230). The processor 140 may transmit the determined speed range information to the vehicle terminal 200 as safety driving guide information (S170).

Figure 4:
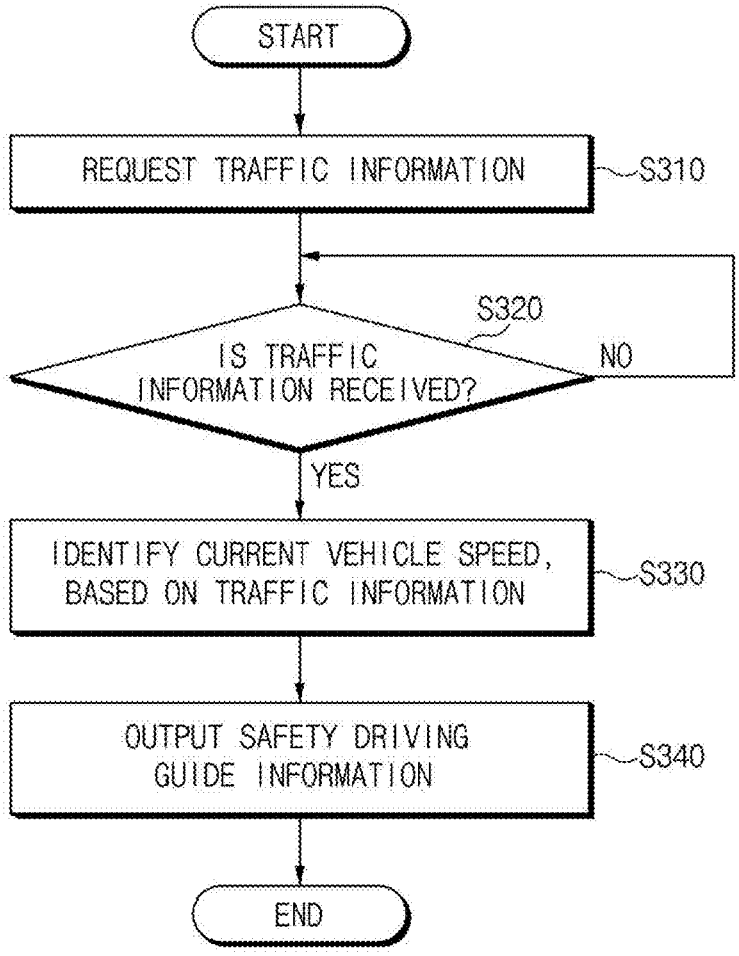
FIG. 4 is a flowchart illustrating a method of providing safety driving guide information by a vehicle terminal according to an embodiment of the present disclosure.

FIG. 4 is a flowchart illustrating a method of providing safety driving guide information by the vehicle terminal according to an embodiment of the present disclosure.

The processor 240 of the vehicle terminal 200 makes a request for traffic information to the traffic information service device 100 (S310). The processor 240 measures the current position of the vehicle using a positioning device mounted in the vehicle and generates a traffic information request message including the measured vehicle position information. The processor 240 transmits the generated traffic information request message to the traffic information service device 100 via the communication device 210.

After requesting the traffic information, the processor 240 determines whether traffic information is received or not (S320). In other words, the processor 240 determines whether traffic information is received from the traffic information service device 100 every predetermined period.

When it is determined that the traffic information is received, the processor 240 identifies the current vehicle speed (S330). The processor 240 may measure the current speed of the vehicle through a speed sensor.

The processor 240 outputs safety driving guide information included in the traffic information, based on the current vehicle speed (S340). The processor 240 determines which of a safety range, hazard ranges, and collision risk ranges the current vehicle speed belongs to. The processor 240 outputs the current vehicle speed by mapping the current vehicle speed with the safety driving guide information.

FIGS. 5 to 11 are exemplary views illustrating a traffic information display method according to an embodiment of the present disclosure.

Figure 5:
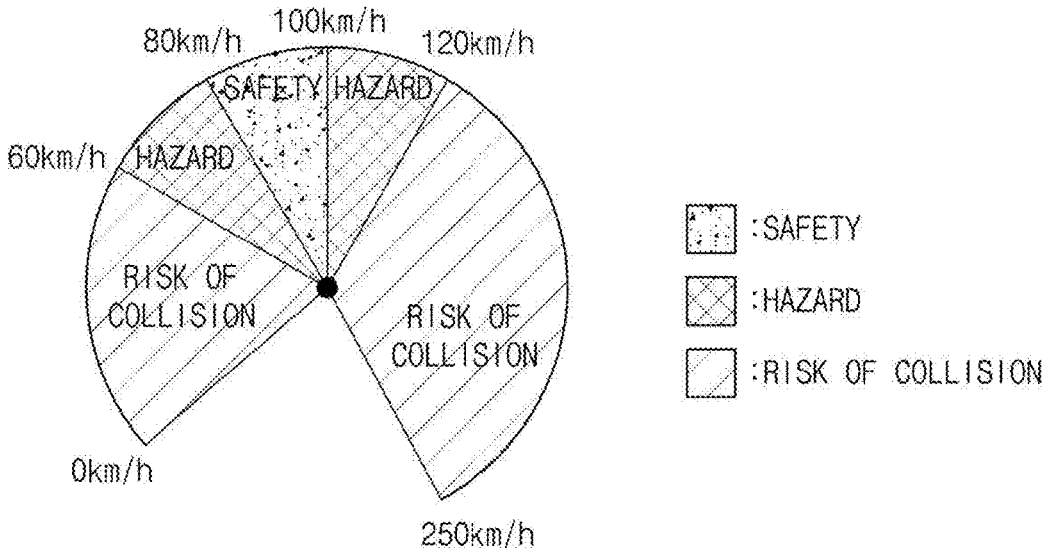
FIGS. 5 to 11 are exemplary views illustrating a traffic information display method according to an embodiment of the present disclosure.

When receiving traffic information from the traffic information service device 100, the vehicle terminal 200 may display speed ranges in different colors on the speedometer of the cluster, based on speed range information (safety driving guide information) included in the traffic information. As illustrated in FIG. 5, based on the safety driving guide information, the vehicle terminal 200 may display the speed range of 0 km/h to 60 km/h and the speed range of 120 km/h to 250 km/h as collision risk ranges, may display the speed range of 60 km/h to 80 km/h and the speed range of 100 km/h to 120 km/h as hazard ranges, and may display the speed range of 80 km/ to 100 km/h as a safety range.

Figure 6:
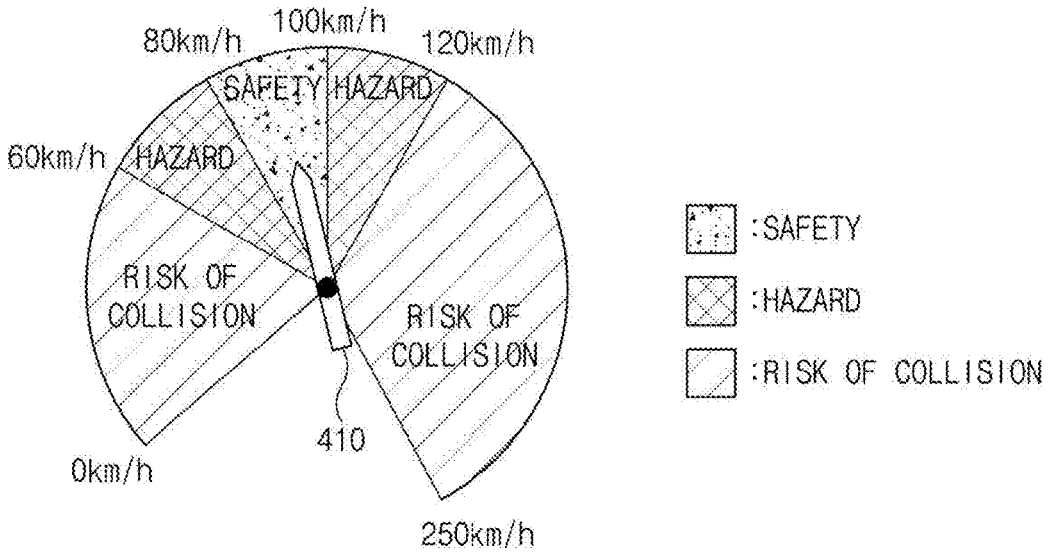
Figure 7:
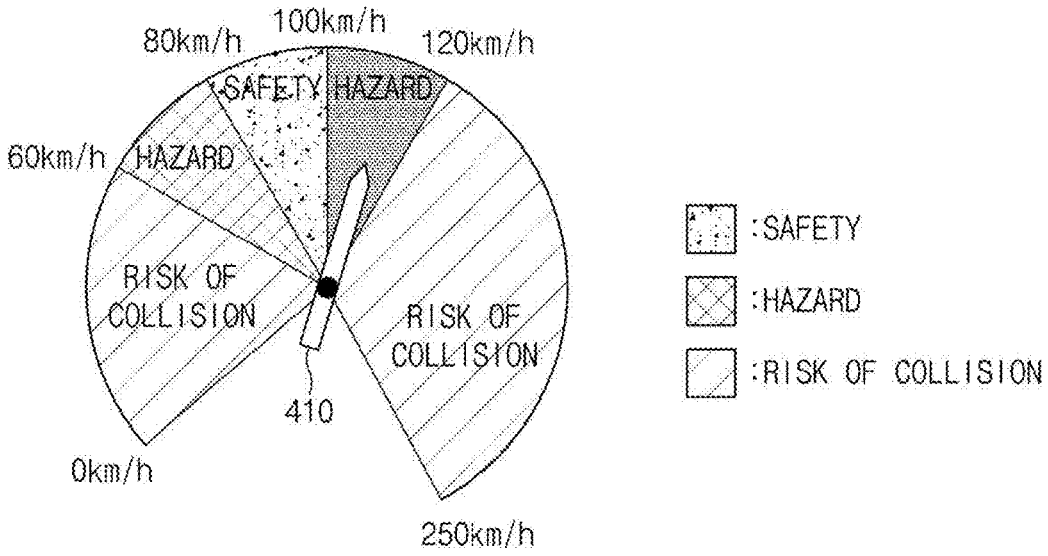

Furthermore, the processor 240 may measure the current travel speed of the vehicle, may adjust the position of a needle 410 to cause the needle 410 to point to the graduation on the speedometer that is mapped with the measured current travel speed, and may display the needle 410 as illustrated in FIGS. 6 and 7. In this case, the processor 240 may more darkly display the speed range to which the needle 410 indicating the current travel speed of the vehicle belongs. For example, when the current travel speed of the vehicle is 95 km/h and belongs to the safety range, the processor 240 may adjust the color depth of the safety range. In addition, when the current travel speed of the vehicle is changed to 110 km/h, the needle 410 indicating the current travel speed of the vehicle is located in the hazard range, and therefore the processor 240 returns the color depth of the safety range to the default and adjusts the color depth of the corresponding hazard range.

Figure 8:
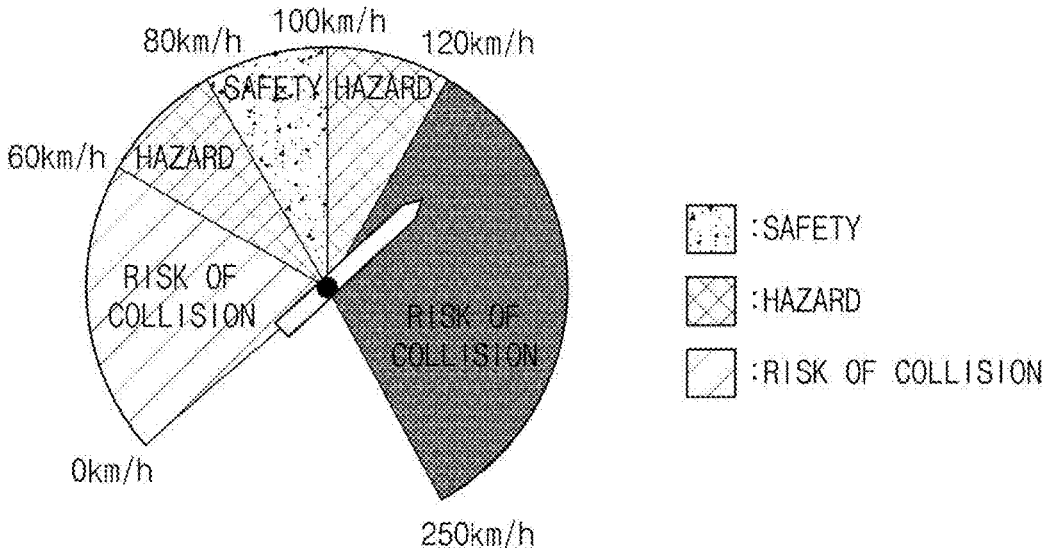
Figure 9:
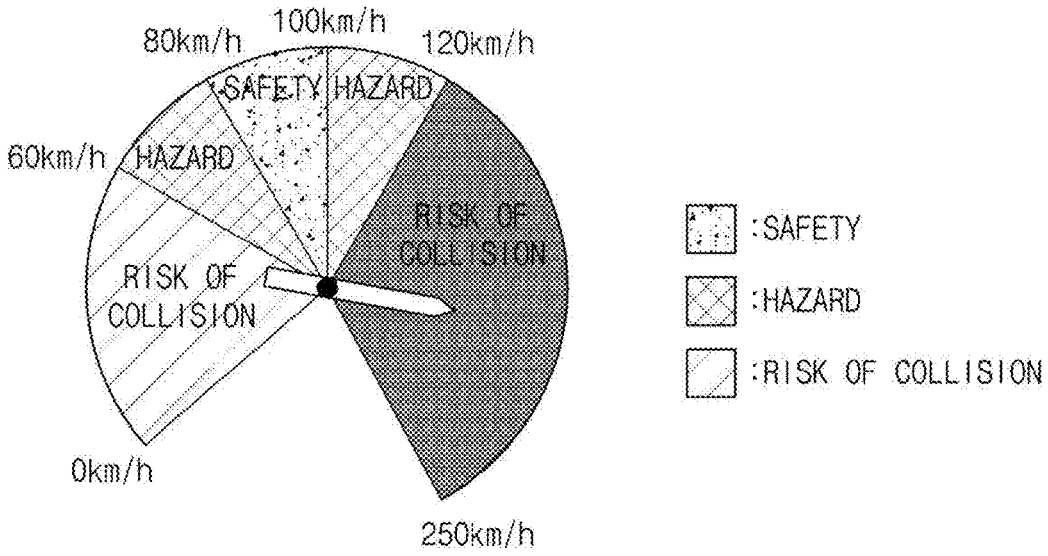

When the travel speed of the vehicle continually increases in a specific range, the processor 240 may more darkly display the color of the corresponding speed range or may cause the corresponding speed range to flash on and off. For example, when the current vehicle speed is in the forward collision risk range as illustrated in FIG. 8, the processor 240 makes the color depth of the forward collision risk range dark. Thereafter, when the vehicle speed continually increases as illustrated in FIG. 9, the processor 240 may make the color depth of the corresponding forward collision risk range darker.

Figure 10:
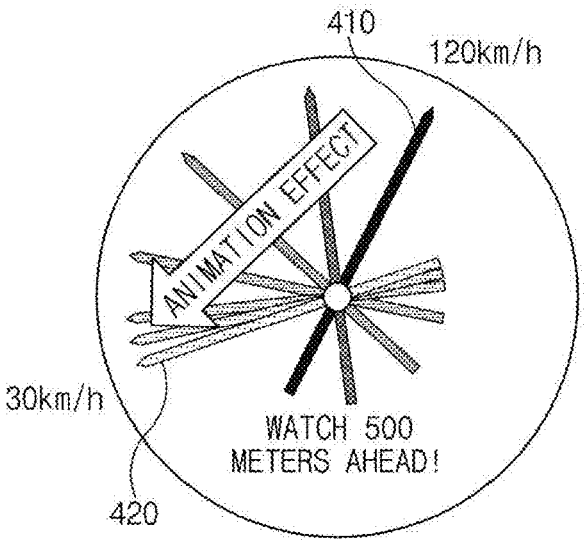
Figure 11:
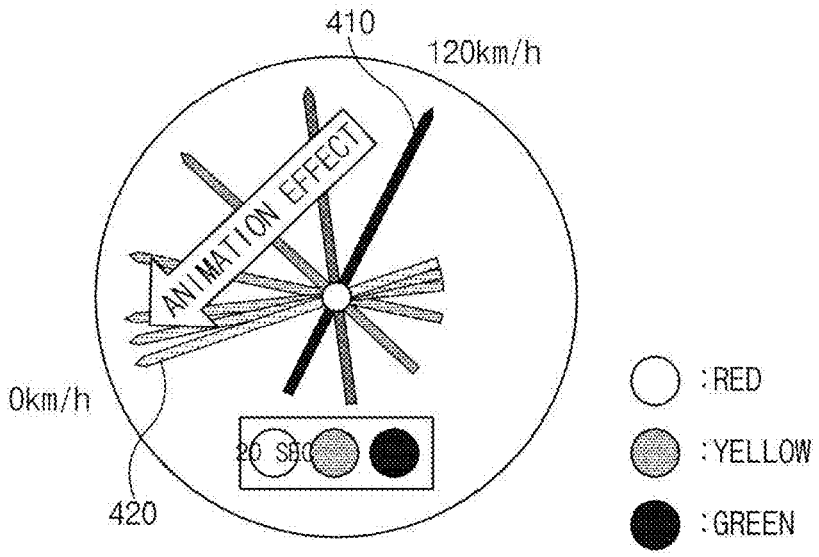

When receiving a forward speed change point and a target speed from the traffic information service device 100, the vehicle terminal 200 may differently display the current vehicle speed and the target speed. As illustrated in FIG. 10, the vehicle terminal 200 causes the first needle 410 to indicate the current vehicle speed and causes a second needle 420 to indicate the target speed. Furthermore, the vehicle terminal 200 may calculate the remaining distance to the forward speed change point and may output the remaining distance as illustrated in FIG. 10 (e.g., "Watch 500 meters ahead!").

The vehicle terminal 200 may provide an animation effect that a needle moves to the target speed with respect to the first needle 410 indicating the current vehicle speed. In this case, the second needle 420 with a different color may be moved while the first needle 410 remains in its position.

The vehicle terminal 200 moves the second needle 420 faster to the graduation corresponding to the target speed, with an increase in the difference between the current vehicle speed and the target speed. For example, when the vehicle speed is in the safety range with respect to the forward traffic condition, the vehicle terminal 200 may cause the second needle 420 to move to the target speed over two seconds, and when the vehicle speed is in the hazard range, the vehicle terminal 200 may cause the second needle 420 to reach the target speed over 0.5 seconds.

When receiving the position, the current signal state, and the signal change frequency of a traffic light, the vehicle terminal 200 calculates a target speed, based on the signal state at the time of reaching the position of the traffic light. The vehicle terminal 200 determines the target speed to be 0 km/h when the signal state at the time that the vehicle reaches the position of the traffic light is a stop signal. The vehicle terminal 200 causes the first needle 410 to indicate the current vehicle speed and causes the second needle 420 to indicate the target speed. At this time, the vehicle terminal 200 may display the current signal state (e.g., a stop signal) of the forward traffic light and the amount of time (e.g., 20 seconds) remaining until the corresponding signal state is changed.

Figure 12:
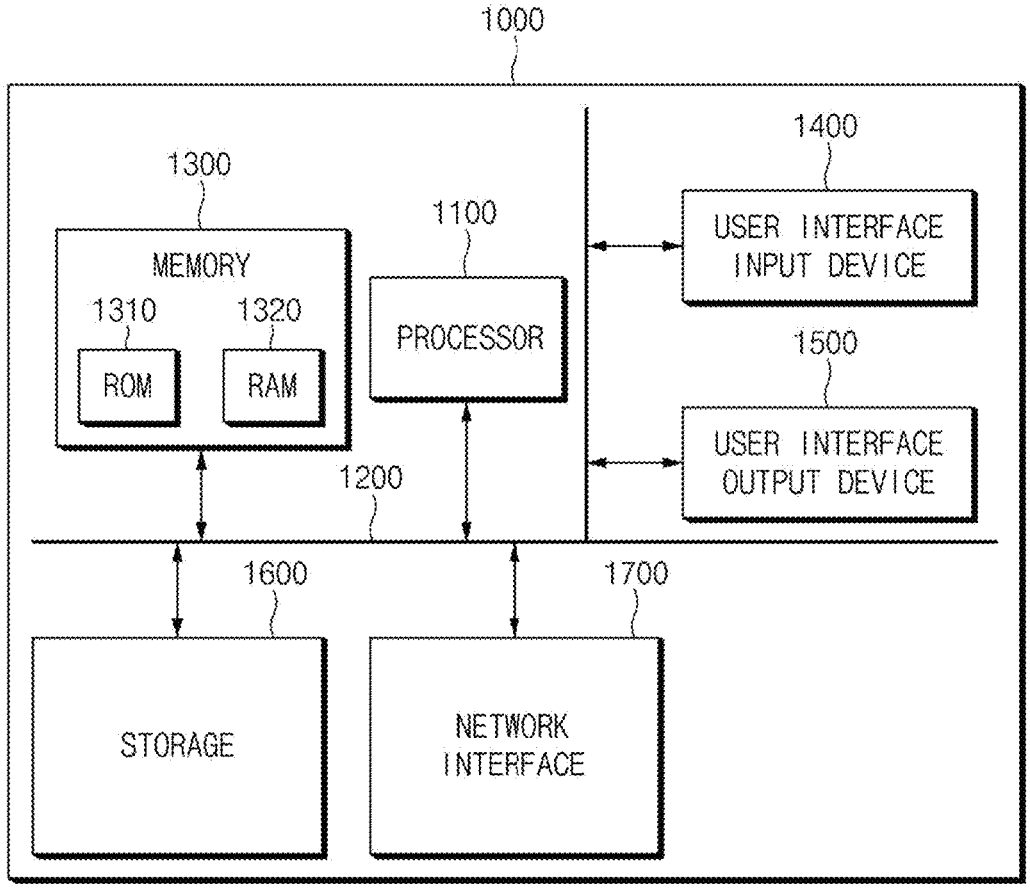
FIG. 12 is a block diagram illustrating a computing system for executing a vehicle safety driving guidance method according to an embodiment of the present disclosure.

FIG. 12 is a block diagram illustrating a computing system 1000 for executing a vehicle safety driving guidance method according to an embodiment of the present disclosure.

Referring to FIG. 12, the computing system 1000 may include at least one processor 1100, a memory 1300, a user interface input device 1400, a user interface output device 1500, storage 1600, and a network interface 1700, which are connected with each other via a bus 1200.

The processor 1100 may be a central processing unit (CPU) or a semiconductor device that processes instructions stored in the memory 1300 and/or the storage 1600. The memory 1300 and the storage 1600 may include various types of volatile or non-volatile storage media. For example, the memory 1300 may include a ROM (Read Only Memory) 1310 and a RAM (Random Access Memory) 1320.

Thus, the operations of the method or the algorithm described in connection with the embodiments disclosed herein may be embodied directly in hardware or a software module executed by the processor 1100, or in a combination thereof. The software module may reside on a storage medium (that is, the memory 1300 and/or the storage 1600) such as a RAM memory, a flash memory, a ROM memory, an EPROM memory, an EEPROM memory, a register, a hard disk, a removable disk, or a CD-ROM. The exemplary storage medium may be coupled to the processor 1100, and the processor 1100 may read information out of the storage medium and may record information in the storage medium. Alternatively, the storage medium may be integrated with the processor 1100. The processor 1100 and the storage medium may reside in an application specific integrated circuit (ASIC). The ASIC may reside within a user terminal. In another case, the processor 1100 and the storage medium may reside in the user terminal as separate components.

According to the present disclosure, the vehicle safety driving guidance system and method guides a safety travel speed using real-time traffic information, thereby enabling a driver to drive a vehicle at a safe travel speed according to ever-changing traffic conditions.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims. Therefore, the exemplary embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A vehicle safety driving guidance system comprising:

a vehicle terminal; and a traffic information service device, wherein the traffic information service device includes:

a communication device configured to perform communication with the vehicle terminal;

a data collection device configured to collect traffic information of a road section on which a vehicle having the vehicle terminal mounted therein travels, wherein the traffic information of the road section is collected from probe vehicles; and a processor configured to provide safety driving guide information of the road section based on the traffic information collected by the data collection device, and wherein the vehicle terminal displays a target speed included in the safety driving guide information and a current vehicle speed.

2. The vehicle safety driving guidance system of claim 1, wherein the traffic information includes at least one of travel speeds of the probe vehicles travelling on the road section, speed limits, a presence or absence of a traffic light, signal state information of the traffic light, or a congestion point.

3. The vehicle safety driving guidance system of claim 1, wherein the processor calculates an average travel speed by collecting travel speeds of the probe vehicles travelling on the road section and determines a speed range of the vehicle based upon setting the calculated average travel speed as a safety travel speed.

4. The vehicle safety driving guidance system of claim 3, wherein the processor calculates a mean error by calculating an error between the safety travel speed and a travel speed of each of the probe vehicles and sets a safety range using the calculated mean error and the safety travel speed.

5. The vehicle safety driving guidance system of claim 3, wherein the processor sets a hazard range using a middle value between the safety travel speed and a highest speed among the travel speeds of the probe vehicles and an error between the middle value and the highest speed.

6. The vehicle safety driving guidance system of claim 5, wherein the processor sets a range above the highest speed of the hazard range as a range with a risk of collision.

7. The vehicle safety driving guidance system of claim 3, wherein the processor sets a hazard range using a middle value between the safety travel speed and a lowest speed among the travel speeds of the probe vehicles and an error between the middle value and the lowest speed.

8. The vehicle safety driving guidance system of claim 7, wherein the processor sets a range below the lowest speed of the hazard range as a range with a risk of collision.

9. The vehicle safety driving guidance system of claim 1, wherein the processor determines a safety range, a hazard range, and a collision risk range with respect to speed limits of the road section and provides the safety range, the hazard range, and the collision risk range as the safety driving guide information.

10. The vehicle safety driving guidance system of claim 1, wherein the vehicle terminal displays a speedometer by dividing a range between a lowest speed and a highest speed of the speedometer into a safety range, a hazard range, and a collision risk range, based on the safety driving guide information.

11. The vehicle safety driving guidance system of claim 10, wherein the vehicle terminal additionally displays a current signal state of a traffic light in the road section and a remaining amount of time until the current signal state is changed, based on the safety driving guide information that includes the current signal state and a signal change frequency of the traffic light.

12. The vehicle safety driving guidance system of claim 1, wherein the vehicle terminal additionally displays a remaining distance from a position of the vehicle to a speed change point included in the safety driving guide information.

13. A vehicle safety driving guidance system comprising:

a vehicle terminal; and a traffic information service device, wherein the traffic information service device includes:

a communication device configured to perform communication with the vehicle terminal;

a data collection device configured to collect traffic information of a road section on which a vehicle having the vehicle terminal mounted therein travels, wherein the traffic information of the road section is collected from probe vehicles; and a processor configured to provide safety driving guide information of the road section based on the traffic information collected by the data collection device, and wherein the processor extracts at least one of a congestion point and a position of a traffic light in the road section as a speed change point, determines a target speed at the speed change point, and provides the determined target speed as the safety driving guide information.

14. The vehicle safety driving guidance system of claim 13, wherein the processor additionally provides information regarding a current signal state of the traffic light and a signal change frequency of the traffic light when extracting the position of the traffic light as the speed change point.

15. A vehicle safety driving guidance method comprising:

receiving a request for traffic information from a vehicle terminal;

collecting traffic information of a road section on which a vehicle having the vehicle terminal mounted therein travels, in response to the request from the vehicle terminal, wherein the traffic information of the road section is collected from probe vehicles; and providing safety driving guide information of the road section based on the collected traffic information, wherein after the providing of the safety driving guide information, the vehicle terminal displays a current vehicle speed and a target speed included in the safety driving guide information.

16. The vehicle safety driving guidance method of claim 15, wherein the collecting of the traffic information includes:

collecting at least one of travel speeds of the probe vehicles travelling on the road section, speed limits, a presence or absence of a traffic light, signal state information of the traffic light, or a congestion point.

17. The vehicle safety driving guidance method of claim 15, wherein the providing of the safety driving guide information includes:

setting a safety travel speed, based on travel speeds of the probe vehicles travelling on the road section; and setting a speed range with respect to the safety travel speed.

18. The vehicle safety driving guidance method of claim 17, wherein the setting of the speed range includes:

calculating a mean error by calculating an error between the safety travel speed and a travel speed of each of the probe vehicles and setting a safety range using the calculated mean error and the safety travel speed.

19. The vehicle safety driving guidance method of claim 18, wherein the setting of the speed range includes:

setting a hazard range using a middle value between the safety travel speed and a highest speed among the travel speeds of the probe vehicles and an error between the middle value and the highest speed.

20. The vehicle safety driving guidance method of claim 19, wherein the setting of the speed range includes:

setting a hazard range using a middle value between the safety travel speed and a lowest speed among the travel speeds of the probe vehicles and an error between the middle value and the lowest speed.

21. The vehicle safety driving guidance method of claim 15, wherein the providing of the safety driving guide information includes:

extracting at least one of a congestion point and a position of a traffic light in the road section as a speed change point, determining a target speed at the speed change point, and providing the determined target speed as the safety driving guide information.

22. The vehicle safety driving guidance method of claim 21, wherein the providing of the safety driving guide information further includes:

additionally providing information regarding a current signal state of the traffic light and a signal change frequency of the traffic light when extracting the position of the traffic light as the speed change point.

23. The vehicle safety driving guidance method of claim 16, wherein the providing of the safety driving guide information includes:

determining a safety range, a hazard range, and a collision risk range with respect to speed limits of the road section and providing the safety range, the hazard range, and the collision risk range as the safety driving guide information.

24. The vehicle safety driving guidance method of claim 15, wherein after the providing of the safety driving guide information, the vehicle terminal displays a speedometer by dividing a range between a lowest speed and a highest speed of the speedometer into a safety range, a hazard range, and a collision risk range, based on the safety driving guide information.

* * * * *